US008302826B2

(12) United States Patent
Gouldson

(10) Patent No.: US 8,302,826 B2
(45) Date of Patent: Nov. 6, 2012

(54) MICRO-BEAM INTIMATE APPAREL HANGER

(75) Inventor: Stanley F. Gouldson, Northport, NY (US)

(73) Assignee: Spotless Plastics Pty. Ltd, Moorabbin, Victoria (AU)

( * ) Notice: Subject to any disclaimer, the term of this patent is extended or adjusted under 35 U.S.C. 154(b) by 182 days.

(21) Appl. No.: 12/816,625

(22) Filed: Jun. 16, 2010

(65) Prior Publication Data

US 2011/0011901 A1 Jan. 20, 2011

Related U.S. Application Data

(60) Provisional application No. 61/187,946, filed on Jun. 17, 2009.

(51) Int. Cl.
*A41D 27/22* (2006.01)

(52) U.S. Cl. ..... 223/96; 223/95

(58) Field of Classification Search ..... 223/85, 223/88, 95, 96; 40/322
See application file for complete search history.

(56) References Cited

U.S. PATENT DOCUMENTS

| | | | | |
|---|---|---|---|---|
| 4,115,940 | A | 9/1978 | Phillips | |
| 4,209,879 | A | 7/1980 | Paajanen | |
| 4,623,079 | A | 11/1986 | Tendrup et al. | |
| 4,703,878 | A * | 11/1987 | Louw | 223/95 |
| 4,871,097 | A * | 10/1989 | Blanchard et al. | 223/85 |
| 4,978,043 | A * | 12/1990 | Uke | 223/88 |
| 5,062,556 | A | 11/1991 | Willpiitz | |
| 5,065,916 | A * | 11/1991 | Fildan | 223/85 |
| 5,096,101 | A * | 3/1992 | Norman et al. | 223/85 |
| 5,411,189 | A | 5/1995 | Gouldson | |
| 5,503,310 | A | 4/1996 | Zuckerman et al. | |
| 6,286,735 | B1 * | 9/2001 | Zuckerman | 223/96 |
| 6,467,659 | B2 * | 10/2002 | Gouldson | 223/96 |
| 6,516,980 | B1 * | 2/2003 | Goldman | 223/85 |
| 6,588,634 | B2 * | 7/2003 | Gouldson et al. | 223/96 |
| 7,377,409 | B1 * | 5/2008 | Brown | 223/88 |
| 2002/0050044 | A1 * | 5/2002 | Marshall et al. | 29/426.4 |
| 2007/0090134 | A1 | 4/2007 | Wu | |
| 2009/0120973 | A1 | 5/2009 | Ho | |

FOREIGN PATENT DOCUMENTS

| | | | |
|---|---|---|---|
| DE | 8629686 | U1 | 2/1987 |
| EP | 0 470 585 | A1 | 2/1992 |
| EP | 0 925 749 | A1 | 6/1999 |
| GB | 2181045 | A * | 4/1987 |
| WO | WO 98/00051 | | 1/1998 |

OTHER PUBLICATIONS

British Search Report received from the UK Patent Office, dated Oct. 7, 2010.

* cited by examiner

*Primary Examiner* — Nathan Durham
(74) *Attorney, Agent, or Firm* — Scully, Scott, Murphy & Presser, PC

(57) ABSTRACT

In a lightweight intimate apparel hanger, the hanger body has a first arm extending from a hook of the hanger to a first end of the body and a second arm extending from the hook to a second end of the body. The first arm and the second arm body each have an upper flange, a lower flange and a middle web connecting the upper flange and the lower flange. The first arm has a height H defined as from the upper flange to the lower flange and a width W defined as the width of the upper flange and the lower flange, the ratio of the width W to the height H (W/H) larger than 1. The hanger can has a top sizer attaching means for attaching a top sizer or a lower neck sizer attaching means for attaching a lower neck sizer.

22 Claims, 5 Drawing Sheets

100
110
112
113
114
115
116
117
120
121
122
123
124
130
132
134
136
140
142
144
146
152
154
6
2
X
Y
Z
200
210
212
213
214
215
216
217
220
221
222
223
230
232
234
236
240
242
244
246
252
254
256
300
310
320
330
340
350
352
354
4
W1
H1
156

4A
4A
3200
3100
210
200
3000

4300
4100
4800
4820
4120
4200
4800
4820
4220
4600
4700

4000
4400
4300
4100
4500

3310
3300
3320
3200
3300
3100
3000

400
440
210
200
430
410
450

430
410
484
480
482
412
420
494
490
492
460
470

4300
4400
7A
7A
4000
4600
4200
4100
4500

430
440
480
7
7
400
460
420
410
450

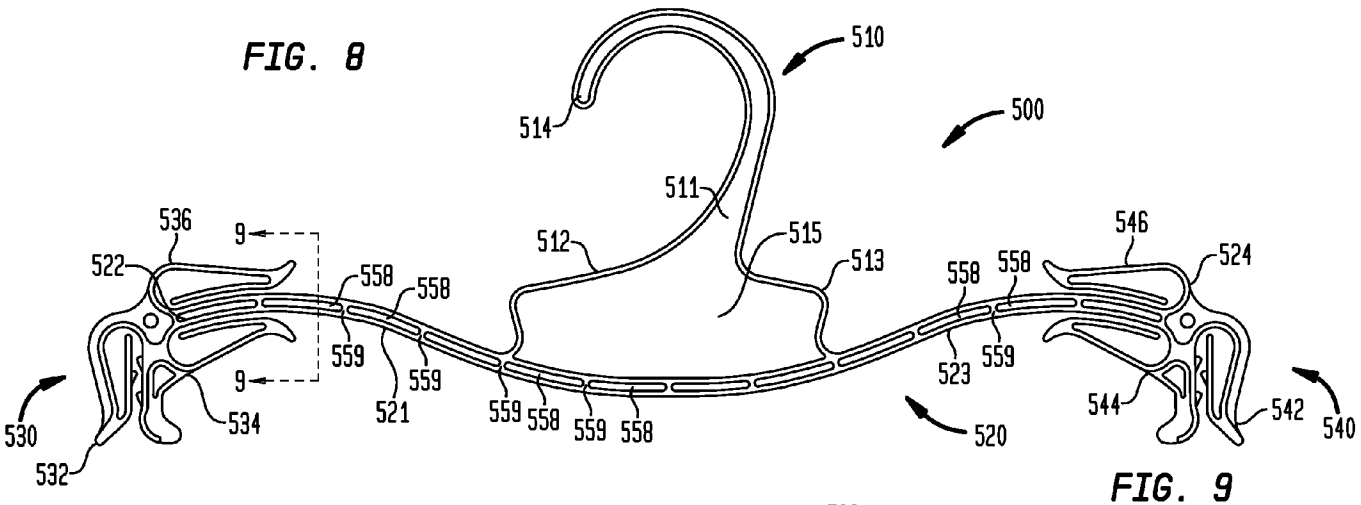
FIG. 8
FIG. 9
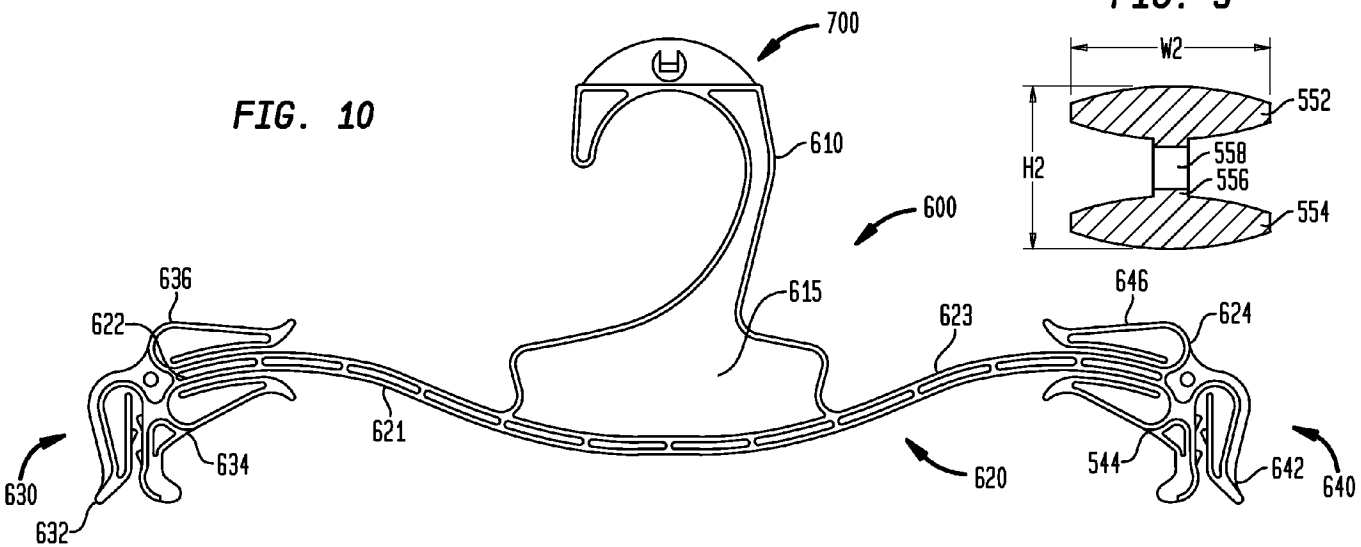
FIG. 10

MICRO-BEAM INTIMATE APPAREL HANGER

CROSS REFERENCE OF RELATED APPLICATIONS

Under 35 U.S.C. §119(e), this application claims priority of U.S. Provisional Patent Application Ser. No. 61/187,946 filed Jun. 17, 2009, entitled "MICRO-BEAM INTIMATE APPAREL HANGER", the disclosure of which is hereby incorporated by reference in its entirety for all purposes.

BACKGROUND OF THE INVENTION

1. Field of Invention

The present invention relates generally to plastic molded garment hangers as are widely used for the purpose of shipping and displaying garments. More specifically, the present invention relates to a lightweight intimate apparel hanger with an improved hanger body structure, especially a hanger beam, which consumes less material and less energy for manufacture and processing the material as compared to the existing intimate apparel hangers, and which enhances structural stability and mechanical strength of the hanger against undesirable deformation and distortion of the hanger body.

2. Description of Related Art

In the area of retail garment sales, so-called Garment-On-Hanger (GOH) programs have become preferred by retailers. In a GOH program, garments are delivered to retail merchants already suspended from hangers, where upon arrival at the retail location the garments are immediately placed on display for sale. Those hangers are normally plastic molded hangers as widely used for the purpose of shipping and displaying garments.

In particular, retailers have specified particular hangers or hanger characteristics among suppliers in order to achieve uniformity on their sales floors. To this end, standards as to hanger size, shape, performance characteristics, etc., are maintained, for example, by organizations such as the Voluntary Inter-industry Commerce Standards Association (VICS). Intimate apparel hangers are one of the standardized hangers under the VICS standards, which are suitable for suspending and displaying intimate apparels, such as underwear, slips, brassieres, swimwear and so on.

With the continuing consumption of the natural resources, it is popular and necessary in the manufacturing industry to optimize the product design to save materials and energy and concomitantly reduce the manufacturing and transportation costs, without compromising performance. The resultant product under such a material and energy saving concept is recognized as an environmentally friendly product, and is much more market competitive than its prior art counterpart. In the intimate apparel hanger molding industry, millions of plastic intimate apparel hangers are manufactured each year. Thus, an environmentally friendly intimate apparel hanger would provide a significant commercial advantage to the manufacturer, transporter and retailer in the industry.

Accordingly, there is a need for a novel intimate apparel hanger that uses less material for manufacturing and still maintains its structural integrity and mechanical performance to satisfy the industry standards, for example, the VICS standards.

Accordingly, there is a need for a novel intimate apparel hanger that is lightweight and easy to handle while still maintaining the performance of the hanger.

Accordingly, there is a need for a novel intimate apparel hanger that effectively reduces manufacturing and transportation costs and uses less material to enhance the environment.

Moreover, the existing intimate garment hangers known in the prior art generally exhibit undesirable deformation of the hanger body, especially the hanger beam, under a certain load applied by the intimate apparel. For example, in the plane of the hanger body, the prior art hanger tends to bow to show an upward curve adjacent the middle of the beam, under the force applied on the opposite ends of the beam.

In addition, the hanger beam tends to flex to extend out of the plane of the hanger body, with the respective ends of the beam moving toward the middle of the hanger. Accordingly, viewing from above the hanger body, the hanger body takes a distorted C shape. In a GOH system where a large amount of garments are transported and presented together with their hangers, such distortion significantly consumes the space budget for transporting and presenting the garments. Concomitantly, the garment-presentation is not satisfactory because the garments cannot be perfectly aligned and disposed in a plane due to the distortion of the hangers.

Frequently, the hanger beam tends to twist around a horizontal or longitudinal axis of the hanger body, when, for example, the clothes hung by the hanger are intertwined with adjacent clothes.

Such deformation of the intimate apparel hangers significantly reduces the lifetime of the hangers and sometimes even breaks the hangers, which in turn causes problems in garment transportation and presentation. The above disadvantages are more prominent for intimate apparel hangers, which are normally small in dimensions.

Accordingly, there is a need in the industry for novel intimate apparel hangers, which have improved structural stability against the distortion of the hanger body, especially the deformation of the hanger beam.

BRIEF SUMMARY OF THE INVENTION

Therefore, in order to overcome certain deficiencies of the prior art, provided according to one aspect of the present invention is a lightweight intimate apparel hanger, comprising a hook member and a body connected to the hook at a lower neck region of the hanger. The body includes a first arm extending from the hook to a first end of the body and a second arm extending from the hook to a second end of the body. The hanger further includes a first composite garment retaining clip integrally molded to the first end of the body and a second composite garment retaining clip integrally molded to the second end of the body. The first arm and the second arm each comprise an upper flange, a lower flange and a middle web connecting the upper flange and the lower flange. Specifically, the first arm has a height H defined as from the upper flange to the lower flange and a width W defined as the width of the upper flange and the lower flange, the ratio of the width W to the height H (W/H) being larger than 1.

Compared to the prior art hangers known in the industry, such as the existing intimate apparel hangers under the VICS standards, the intimate apparel hanger according to the present invention contemplates a hanger beam structure, which strategically regulates the ratio of the height to the width of the hanger beam to provide a relatively wider and shorter hanger beam.

Consequently, the structural stability of the hanger beam is greatly improved so as to effectively avoid the undesirable deformation of the hanger beam. Thus, the distortion of the hanger beam out of the plane of the hanger body can be effectively avoided. Accordingly, the space for transporting and presenting garments can be used efficiently, and satisfactory garment-presentation can be achieved. Moreover, the lifetime of the hangers is greatly improved, and the accidental fracture or break of the hangers is effectively reduced.

While improving the structural stability of the hanger beam, the intimate apparel hangers according to the invention also save resin material and energy for processing the material. For example, compared to the prior art hangers known in the industry, such as the existing intimate apparel hangers under the VICS standards, the intimate apparel hanger according to the invention can save about 15 grams of resin material for each hanger, and, concomitantly, the energy for processing the material. Considering the mass production volume of plastic molded hangers each year in the scale of billions, the cost for manufacturing the hangers and the cost for the transportation of raw material are significantly reduced. Furthermore, due to the less material processed, emission of carbon dioxide into the environment is also reduced greatly, which enhances the environment.

Preferably, the upper flange, the lower flange and the middle web form a substantially I-beam cross section of the body.

Preferably, the first composite clip includes a first vertical garment retaining clip, a first lower garment retaining clip disposed under the hanger body, and a first upper garment retaining clip disposed above the hanger body. Preferably, the second composite clip includes a second vertical garment retaining clip, a second lower garment retaining clip disposed under the hanger body, and a second upper garment retaining clip disposed above the hanger body.

Preferably, the first arm and the second arm are substantially horizontal, thereby providing a substantially horizontal elongated hanger body.

Preferably, the first arm and the second arm are curved to extend away from the hook and upwardly from the lower neck region of the hanger, thereby providing a wave-like streamlined hanger body.

Preferably, the width W is within the range of 3-8 mm, and the height H is within the range of 3-8 mm. Accordingly, a so-called micro-beam intimate apparel hanger is provided with compact configuration for the hanger body, which consumes less material in manufacture and processing while still maintaining superior structural integrity and mechanical performance, under industry standards, such as VICS standards.

Preferably, the hook includes a planar web and an inner flange bounding one side of the planar web. The inner flange extends substantially from a tip of the hook to the lower neck region of the hanger. Preferably, the inner flange joins the upper flange at one side of the lower neck region, to provide a continuous curve with the upper flange. The inner flange strengthens the hook at the lower neck region, and provides a larger load bearing surface for the hook against a rod or rack for suspending the hanger and the garment.

More preferably, the hook further includes a reinforcing rib disposed oppositely to the inner flange, at the other side of the lower neck region of the hanger. The reinforcing rib joins the upper flange, to provide a continuous curve with the upper flange at the other side of the lower neck region. The reinforcing rib further strengthens the hook at the lower neck region of the hanger.

More preferably, the hook further includes a carved out portion formed in the planar web, adjacent to the lower neck region of the hanger, between the inner flange and the reinforcing rib. The carved out portion of the planar web reduces the weight of the hanger, and reduces the resin material consumption of the hanger.

Preferably, the hanger further includes at least one elongated opening formed in the middle web of the hanger body. More preferably, the hanger includes a plurality of elongated openings, formed in the middle web of the hanger body and separated from each other through a plurality of struts extending between the upper flange and the lower flange. Most preferably, the plurality of elongated openings account for about 10-90% of the total area of the middle web of the hanger body. Thus, the resin material used for molding the hanger is significantly reduced, providing a minimized and compact configuration for the hanger body, while still maintaining structural integrity and mechanical performance under industry standards, such as VICS standards.

Preferably, the hanger body further includes a vertically enlarged portion formed under the hanger hook, adjacent to the lower neck region. The vertically enlarged portion has a height larger than the other portion of the hanger body, so as to structurally strengthen the intersection region of the hanger and provide an anti-twist mechanism for the hanger.

The hanger can further include a top sizer attaching means, disposed at the top of the hook. The top sizer attaching means includes a horizontal flange formed at the top the hook, upon which a top sizer is positioned to display garment-related information, and a vertical flange, extending upwardly substantially from the middle of the horizontal flange, the vertical flange adapted to be received within a cavity of the top sizer. The top sizer attaching means further includes an opening formed in the vertical flange, and a downwardly depending tab extending within the opening. The downwardly pending tab includes a lateral abutment formed at the lower end of the tab, projecting downwardly and outwardly from the opening for engaging a lower surface of a through opening formed in the top sizer. Alternatively, the top sizer attaching means can include at least one snap fit engagement means projecting from the vertical flange. The snap fit engagement means includes a sloped surface and an abutment surface. The abutment surface engages a lower surface of a blind slot formed in the top sizer. Any other suitable combination of a top sizer attaching means and a top sizer is applicable without departing from the present invention. The intimate garment hanger according to the present invention is compatible with any type of top sizer.

The hanger can further include a lower neck sizer attaching means, disposed at the lower neck region of the hanger. The lower neck sizer attaching means is adapted to attach at least one of a side lower neck sizer mounted to a side of the hook adjacent to the lower neck region and a lower neck sizer mounted substantially surrounding the hook adjacent to the lower neck region.

BRIEF DESCRIPTION OF THE DRAWINGS

These and other features, aspects and benefits of the present invention will be made apparent with reference to the following specification and accompanying drawings, where like reference numerals refer to like features across the several views, and wherein:

FIG. 8 illustrates a front elevation view of an intimate apparel hanger according to another exemplary embodiment of the present invention;

FIG. 9 illustrates a sectional view of the hanger body of the intimate apparel hanger shown in FIG. 8, along lines 9-9 in FIG. 8;

FIG. 10 illustrates a front elevation view of an intimate apparel hanger according to another exemplary embodiment of the present invention;

DETAILED DESCRIPTION OF THE INVENTION

Figures 1, 2, 3, 4:
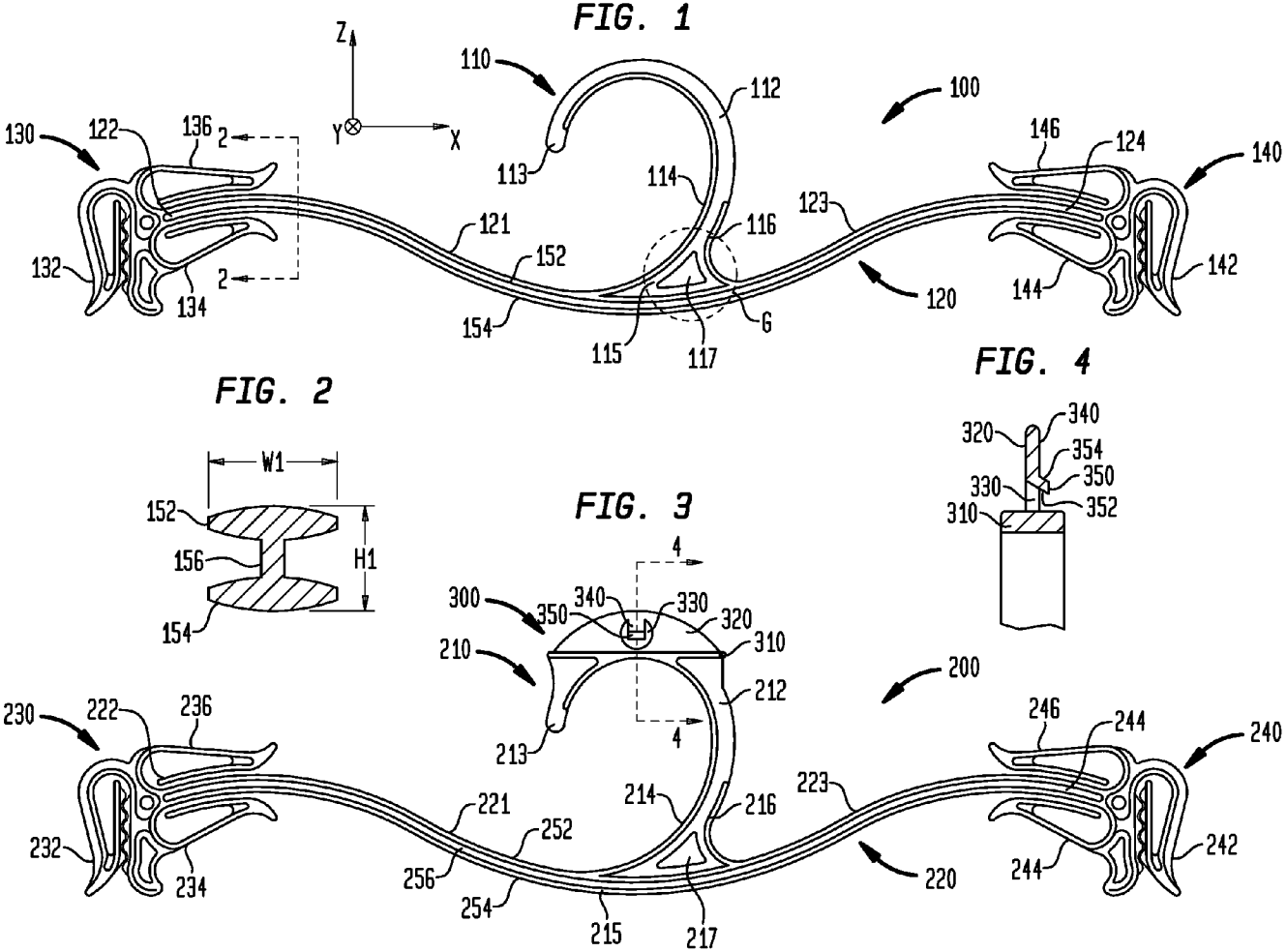
FIG. 1 illustrates a front elevation view of an intimate apparel hanger according to one exemplary embodiment of the present invention.
FIG. 2 illustrates a sectional view of the hanger body of the intimate apparel hanger shown in FIG. 1, along lines 2-2 in FIG. 1.
FIG. 3 illustrates a front elevation view of an intimate apparel hanger, having a sizer attaching means.
FIG. 4 illustrates a sectional view of the intimate apparel hanger shown in FIG. 3, along lines 4-4 in FIG. 3.

Referring now to FIG. 1, illustrated is a plastic molded intimate apparel hanger 100, according to one exemplary embodiment of the present invention.

The hanger 100 generally includes a hook 110 and a hanger body 120 connected to the hook 110. Preferably, the hook 110 is integrally molded to the hanger body 120 through a single plastic molding step, at a lower neck region G of the hanger 100.

In FIG. 1, a three-dimensional coordinate system is defined as shown. The hook 110 extends upward from the hanger body 120, substantially along the vertical Z-axis of the coordinate system in a direction of a height of the hanger. The hanger body 120 extends substantially along the horizontal X-axis of the coordinate system in a direction of a length of the hanger. Furthermore, the hanger body 120 further extends substantially along the lateral Y-axis of the coordinate system in a direction of a width of the hanger.

The hook 110 includes a planar web 112, starting from a tip 113 of the hook 110, and ending at a lower neck end 115 of the hook 110, where the hook 110 joins the hanger body 120. A carved out portion 117 is formed in the lower neck end 115 of the hook, for reducing the weight of the hanger 110 while still maintaining the structural integrity of the hanger 100.

The hook 110 further includes an inner flange 114 disposed at the lower side of the hook 110, substantially extending from the tip 113 to the lower neck end 115 to be naturally joined to the hanger body 120, for strengthening the hook 110. The inner flange 114 has a larger width compared to that of the hook 110. In use, the inner flange 114 engages a bar, rod or any other means for suspending the hanger and the garment. Thus, the inner flange 114 provides a larger load bearing surface when the hanger 100 engages the means for suspending the hanger and the garment. The hook 110 also includes a reinforcing rib 116 disposed at the other side of the planer web 112, opposite to the inner flange 114. The reinforcing rib 116 is curved to naturally join the hanger body 120, for strengthening the hook 110 and resisting twisting or flexure of the hook 110 when the garment hanger is in use. In the shown embodiment, the reinforcing rib 116 is disposed adjacent to the lower neck region G of the hanger 100. However, the reinforcing rib 116 can also extend substantially along the entire hook 110, i.e., from the tip 113 of the hook to the intersection between the hook 110 and the body 120.

The hanger body 120 includes a pair of oppositely directed arms 121 and 123. The first arm 121 extends from the hook 110 to a first end 122, distal to the hook 110. The second arm 123 extends oppositely from the hook 110 to a second end 124, distal to the hook 110. The first arm 121 and the second arm 123 are preferably structurally and geometrically symmetrical to one another.

The first end 122 and the second end 124 are each equipped with a suitable garment gripping or clipping structure, for suspending and retaining intimate apparel in conjunction with the hanger body 120.

Specifically, the hanger 100 includes a first composite garment retaining clip 130 disposed at the first end 122 and a second composite garment retaining clip 140 disposed at the second end 124 of the hanger body 120, respectively.

The first and second composite garment retaining clips 130 and 140 can assume any configuration suitable for retaining a garment, especially intimate apparel, and preferably, the first and second composite garment retaining clips 130 and 140 are structurally and geometrically symmetrical to one another.

As illustrated in FIG. 1, the first composite garment retaining clip 130 includes a first vertical garment retaining clip 132, molded to the first end 122 of the hanger body 120. The first composite garment retaining clip 130 further includes a first lower garment retaining clip 134, molded to the first end 122 of the hanger body 120, extending inwardly under the hanger body 120 from the end 122 toward the hook 110. The first composite garment retaining clip 130 further includes a first upper garment retaining clip 136, molded to the first end 122 of the hanger body 120, extending inwardly above the hanger body 120 from the end 122 toward the hook 110.

Preferably, the second composite garment retaining clip 140 includes a second vertical garment retaining clip 142, molded to the second end 124 of the hanger body 120. The second composite clip 140 further includes a second lower garment retaining clip 144 molded to the second end 124 of the hanger body 120, extending inwardly under the hanger body 120 from the second end 124 toward the hook 110. The second composite garment retaining clip 140 further includes a second upper garment retaining clip 146 molded to the second end 124 of the hanger body 120, extending inwardly above the body 120 from the second end 124 toward the hook 110.

Although the composite garment retaining clips have been described with respect to the shown embodiment 130 and 140, it should be understood by a person of ordinary skill in the art that the composite garment retaining clips can have any suitable variation, as long as the clips fulfill the functionality of releasably and/or selectively retaining a garment, such as intimate apparel, for example, underwear, slips, brassieres, swimwear and so on.

Referring to FIG. 2, illustrated is a sectional view of the first arm 121 of the hanger body 120, along sectional line 2-2 in FIG. 1. As shown, the first arm 121 includes an upper flange 152, an opposite lower flange 154, and a middle web 156 connecting the upper flange 152 and the lower flange 154 to provide a substantially I-beam configuration. Preferably, the upper flange 152 and the lower flange 154 are substantially horizontal and parallel to one another.

Preferably, in order to provide structural reinforcement for the hanger 100, at one side of the hanger 100, the upper flange 152 and the inner flange 114 are molded to be continuous with each other, to provide a natural curve at the lower neck region G of the hanger 100, where the hook 110 intersects the hanger body 120. More preferably, in order to further provide structural reinforcement for the hanger 100, at the other side of the hanger 100, the upper flange 152 and the reinforcing rib 116 are molded to be continuous with each other, to provide a natural curve at the other side of the lower neck region G of the hanger 100.

As shown in FIG. 2, a first height H1 is defined for the first arm 121, as from the uppermost point of the upper flange 152 to the lowest point of the lower flange 154, along the direction of the Z-axis shown in FIG. 1. A first width W1 is also defined for the first arm 121, substantially as the width of the upper flange 152 and the lower flange 154, along the direction of the Y-axis shown in FIG. 1. Preferably, the ratio of the first width W1 to the first height H1 (W1/H1) is more than 1. More preferably, the first width W1 is within the range of 3-8 mm, and the first height H1 is within the range of 3-8 mm. Accordingly, the intimate apparel hanger 100, according to the current embodiment, provides a so-called micro-beam intimate apparel hanger, with a minimized and compact configuration for the hanger body, which consumes less material during manufacturing and processing, while still maintaining superior structural integrity and superior mechanical performance, relative to the larger, heavier prior art intimate apparel hangers.

Preferably, the first arm 121 is curved to extend away from the hook 110 and upwardly from the lower neck region G of the hanger 100, and the second arm 123 is also curved to extend away from the hook 110 and upwardly from the lower neck region G of the hanger 100, such that the first arm 121 and the second arm 123, in cooperation, provide a wave-like streamlined hanger beam configuration, extending from the first end 122 of the hanger 100 to the second end 124 of the hanger 100.

Referring to FIGS. 3 and 4, illustrated are a front elevation view and a sectional view of an intimate apparel hanger 200, respectively, according to another exemplary embodiment of the present invention.

The garment hanger 200 includes a hook 210 integrally molded with a hanger body 220. The hanger body 220 includes a first arm 221 and a second arm 223, extending to a first end 222 and a second end 224 of the hanger body 220, respectively. A first composite garment retaining clip 230, including a first vertical garment retaining clip 232, a first lower garment retaining clip 234 and a first upper garment retaining clip 236, is molded integrally with the first end 222. A second composite garment retaining clip 240, including a second vertical garment retaining clip 242, a second lower garment retaining clip 244 and a second upper garment retaining clip 246, is molded integrally with the second end 224.

The hook 210 includes a planar web 212 extending from a tip 213 of the hook to a lower neck end 215 of the hook. A carved out portion 217 is formed in the lower neck end 215 to reduce the weight of the hanger 200. The hanger body 220 includes an upper flange 252 and an opposite lower flange 254, connected to each other through a middle web 256. The hook 210 includes an inner flange 214, extending substantially from the tip 213 to the lower neck end 215 and continuously with the upper flange 252, to provide a reinforcing structure for the hanger 200. The hook 210 further includes a reinforcing rib 216, extending at the lower neck end 215 of the hook and substantially continuous with the upper flange 252 of the hanger body, to further reinforce the hanger 200.

Preferably, the first arm 221 and the second arm 223 are formed to provide a wave-like streamlined hanger beam configuration, extending from the first end 222 of the hanger 200 to the second end 224 of the hanger 200.

According to this exemplary embodiment, the intimate apparel hanger 200 is suitable to accommodate a size indicator, preferably a top sizer, for displaying garment related information, especially garment sizes.

Figures 5, 6, 6A, 7:
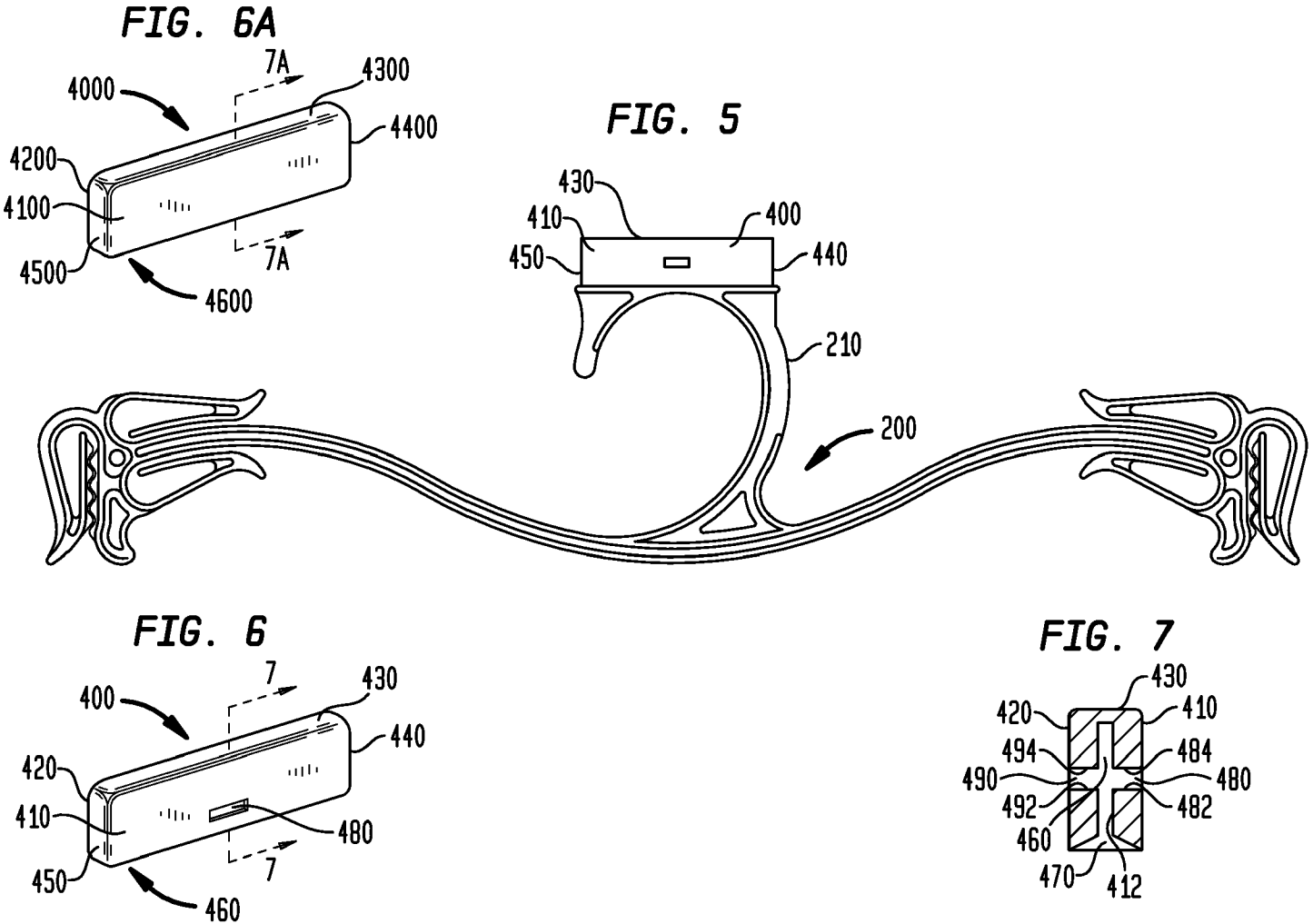
FIG. 5 illustrates a front elevation view of a combination of the intimate apparel hanger shown in FIG. 3 and a top sizer mounted to the hanger.
FIG. 6 illustrates a perspective view of the top sizer shown in FIG. 5.
FIG. 6A illustrates a perspective view of the top sizer shown in FIG. 5A.
FIG. 7 illustrates a sectional view of the top sizer along lines 7-7 in FIG. 6.

As shown, the hanger 200 further includes an attaching means 300 formed at the top of the hook 110, for attaching a top sizer to the hanger 200. FIGS. 5-7 illustrate a top sizer 400, structurally matching the attaching means 300. However, it should be understood by a person of ordinary skill in the art that any other suitable combination of an attaching means and a size indicator are applicable to the hanger 200, without departing from the invention.

Preferably, the attaching means 300, for mounting a top sizer, such as the top sizer 400, onto the hanger 200, includes a horizontal flange 310 formed at the top the hook 210, upon which the top sizer 400 is positioned to display garment-related information. The attaching means 300 further includes a vertical flange 320, extending upwardly substantially from the middle of the horizontal flange 310. The vertical flange 320 is adapted to be received within a cavity of the top sizer 400. The vertical flange 320 projects above the top contour of the hook 210, from the horizontal flange 310. The vertical flange 320 is formed to have a curved profile, to facilitate the attachment of the top sizer 400. Preferably, but not limited to, the vertical flange 320 assumes a crescent-shaped profile.

The attachment means 300 further includes an opening 330, and a downwardly depending tab 340 extending within the opening 330. As best shown in FIG. 4, the tab 340 has a lateral abutment 350 formed at the lower end of the tab 340, projecting downwardly and laterally outwardly from the opening 330, for engaging a complementary structure of the top sizer 400, such as a cavity or opening, to secure the top sizer 400 on the hanger 200. The abutment 350 includes a lower surface 352 and an upper surface 354.

FIG. 5 illustrates a front elevation view of the intimate apparel hanger 200, with the top sizer 400 securely attached to the hook 210 of the hanger 200.

FIG. 6 illustrates a front perspective view of the top sizer 400, and FIG. 7 illustrates a sectional view of the top sizer 400 along lines 7-7 in FIG. 6. As shown, the top sizer 400 includes a pair of opposite front wall 410 and rear wall 420, and a pair of opposite side walls 440 and 450, both connected with each other by a top wall 430. The front wall 410 and the rear wall 420 are substantially vertical and parallel to each other. The side walls 440 and 450 are substantially vertical and parallel to each other. The top wall 430 is preferably horizontal. Each of the above-mentioned walls can be used to provide a displaying surface, on which a size of a garment suspended by the hanger is printed or otherwise visible. Preferably, the front wall 410 or the rear wall 420 is used to provide a larger displaying surface.

The front wall 410, the rear wall 420, the side walls 440 and 450, and the top wall 430 generally define a blind receiving cavity 460, with an entrance 470 at the lower end of the sizer for admitting the vertical flange 320 of the sizer attaching means 300, shown in FIG. 2. Preferably, the entrance 470 of the receiving cavity 460 is formed to expand downwardly to assume a triangle sectional profile, for facilitating the admission of the vertical flange 320 into the receiving cavity 460.

The top sizer 400 further includes a pair of slots 480 and 490, formed in the front wall 410 and rear wall 420, respectively. The slots 480 and 490 are structurally symmetrical and functionally interchangeable to each other. The slot 480 comprises a lower surface 482 and an upper surface 484. The slot 490 comprises a lower surface 492 and an upper surface 494. Both the slots 480 and 490 are dimensioned and positioned to be complementary to the abutment 350 of the sizer attaching means 300. During use, the top sizer 400 is handled to admit the curved vertical flange 320. As the top sizer 400 moves downwardly, the abutment 350 of the attaching means 300 engages the inner surface 412 of the front wall 410.

Due to the resilient nature of the abutment 350 and the downwardly depending tab 340 offered by the plastic materials used to mold the top sizer 400, the abutment 350 and the tab 340 deflect to be received within the cavity 460. Once the abutment 350 approaches the slot 480 or 490, the resilience of the abutment 350 and the tab 340 forces the abutment 350 to project into the slot 480 or 490. Consequently, the upper surface 354 of the abutment 350 engages the upper surface 484 of the slot 480 or the upper surface 492 of the slot 490, and the lower surface 352 of the abutment 350 engages the lower surface 482 of the slot 480 or the lower surface 492 of the slot 490. Accordingly, the top sizer 400 is secured to the hanger hook 210.

After the top sizer 400 is attached to the hanger hook 210, the top sizer 400 sits on the horizontal flange 310. Furthermore, the engagement between the lower surface 352 of the abutment 350 and the lower surface 482 of the slot 480 or the lower surface 492 of the slot 490 prevents the top sizer 400 from being released from the hanger hook 210.

Figures 3A, 4A, 5A, 7A:
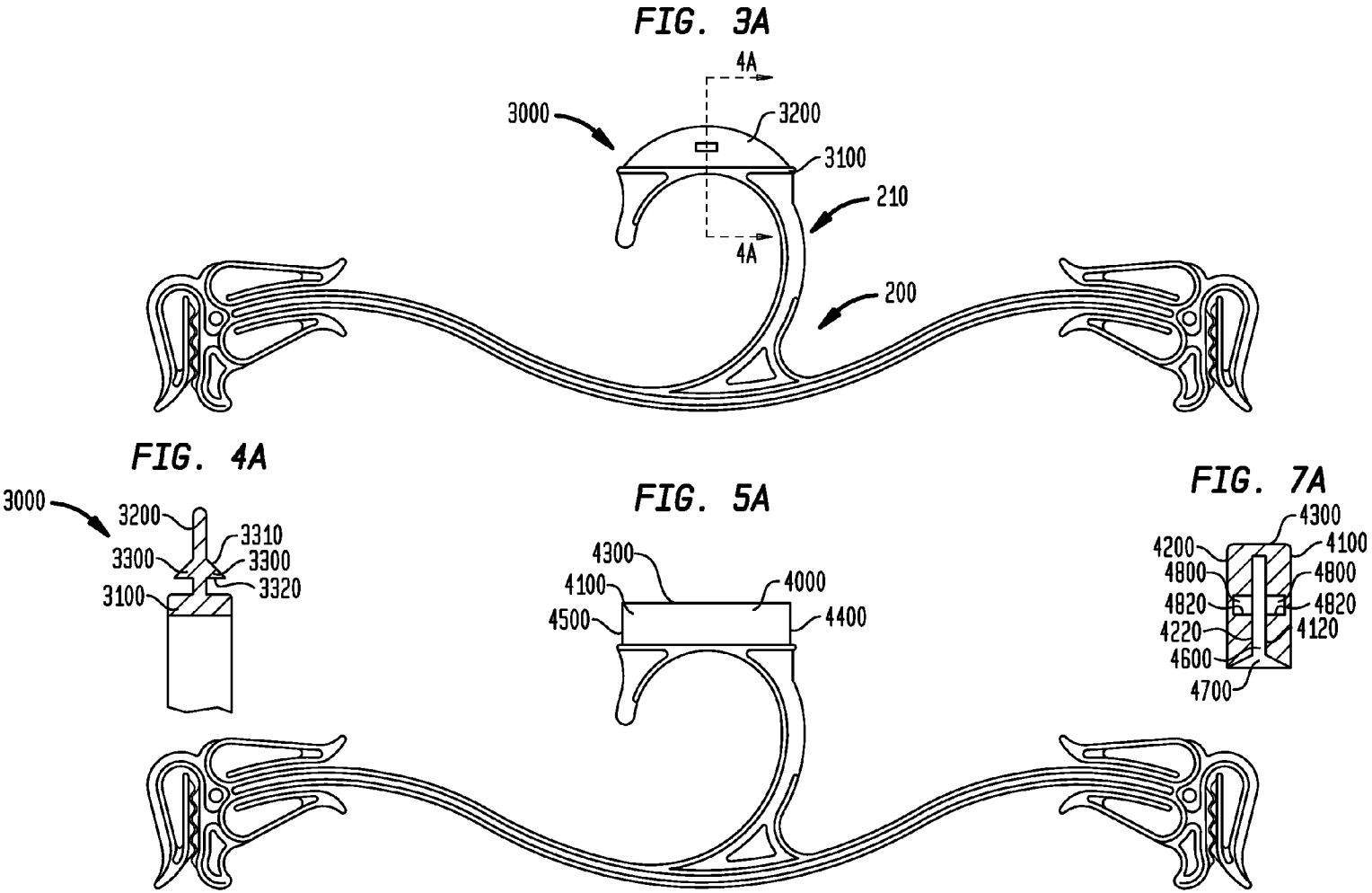
FIG. 3A illustrates a front elevation view of another intimate apparel hanger, having another sizer attaching means.
FIG. 4A illustrates a sectional view of the intimate apparel hanger shown in FIG. 3A, along lines 4A-4A in FIG. 3A.
FIG. 5A illustrates a front elevation view of another combination of the intimate apparel hanger shown in FIG. 3A and another top sizer mounted to the hanger.
FIG. 7A illustrates a sectional view of the top sizer along lines 7A-7A in FIG. 6A.

FIG. 3A illustrates a sizer attaching means 3000 of the hanger 200, which is a variation of the sizer attaching means 300 shown in FIG. 3. FIG. 4A illustrates a sectional view of the sizer attaching means 3000. FIG. 5A illustrates a combination of the sizer attaching means 3000 and a top sizer 4000, which is a variation of the top sizer 400 in FIG. 5. FIGS. 6A and 7A illustrate the front view and sectional view of the top sizer 4000, respectively.

The attaching means 3000 includes a horizontal flange 3100 formed at the top the hook 210, upon which the top sizer 4000 is positioned to display garment-related information. The attaching means 3000 further includes a vertical flange 3200, extending upwardly substantially from the middle of the horizontal flange 3100. The vertical flange 3200 is adapted to be received within a receiving cavity 4600 of the top sizer 4000. The vertical flange 3200 is formed to have a curved profile, to facilitate insertion of the vertical flange into the receiving cavity 4600 of the top sizer 4000. Preferably, but not limited to, the vertical flange 320 assumes a crescent-shaped profile.

The attachment means 3000 further includes a pair of snap fit engagement means 3300, formed at the front and rear sides of the vertical flange 3200, respectively. The snap fit engagement means 3300 project from the vertical flange 3200 to engage a pair of blind slots 4800 formed in the sizer 4000, in a snap fit manner. The snap fit engagement means includes a downwardly sloped surface 3310 and an abutment surface 3320, to substantially assume a triangular profile viewed from a side of the hanger 200.

FIG. 5A illustrates a front view of a combination of the intimate apparel hanger 200 and the top sizer 4000 securely attached to the hook 210 of the hanger 200. As shown in FIG. 5A, the top sizer 4000 does not have any opening at the surfaces of the sizer and the top sizer attaching means 300 is not visible from the outside, thereby providing a continuous and larger surface for displaying garment-related information.

Now referring to FIGS. 6A and 7A, the top sizer 4000 includes a pair of opposite front wall 4100 and rear wall 4200, and a pair of opposite side walls 4400 and 4500, both connected with each other by a top wall 4300. The front wall 4100 and the rear wall 4200 are substantially vertical and parallel to each other. The side walls 4400 and 4500 are substantially vertical and parallel to each other. The top wall 4300 is preferably horizontal. Each of the above-mentioned walls can be used to provide a displaying surface, on which a size of a garment suspended by the hanger is printed or otherwise visible. Preferably, one of the front wall 4100 and the rear wall 4200 is used to provide a larger displaying surface.

The front wall 4100, the rear wall 4200, the side walls 4400 and 4500, and the top wall 4300 generally define the blind receiving cavity 4600, with an entrance 4700 at the lower end of the sizer for admitting the vertical flange 3200 of the sizer attaching means 3000. Preferably, the entrance 4700 of the receiving cavity 4600 is formed to flare downwardly to assume an expanded sectional profile, for facilitating the admission of the vertical flange 3200 into the receiving cavity 4600.

The pair of blind slots 4800 formed in the front wall 4100 and the rear wall 4200 of the top sizer 4000, respectively. The blind slots 4800 are formed to extend from the inner surface 4120 of the front wall 4100 and the inner surface 4220 of the rear wall 4200, respectively. The blind slots 4800 each include a lower surface 4820. The blind slots 4800 are dimensioned and positioned to be complementary to the snap fit engagement means 3300 of the sizer attaching means 3000. In use, the top sizer 4000 is handled to admit the curved vertical flange 3200, as the top sizer 4000 moves downwardly to snap fit the engagement means 3300 into the blind slots 4800, so as to securely mount the top sizer 4000 onto the hanger 200.

Due to the resilient nature of the snap fit engagement means 3300 and the top sizer 4000, the snap fit engagement means 3300 deflect to be received within the cavity 4600, by engaging the sloped surfaces 3310 with the inner surface 4120 of the front wall 4100 and the inner surface 4220 of the rear wall 4200. Once the sloped surfaces 3310 pass over the lower surfaces 4820 of the blind slots 4800, the snap fit engagement means 3300 project into the blind slots 4800, and consequently, the abutment surfaces 3320 of the snap fit engagement means 3300 engage the lower surfaces 4820 of the blind slots 4800. Accordingly, the top sizer 4000 is secured to the hanger hook 210. After the top sizer 4000 is attached to the hanger hook 210, the top sizer 4000 sits on the horizontal flange 3100. Furthermore, the engagement between the lower surfaces 4820 of the bind slots 4800 and the abutment surfaces 3320 of the snap fit engagement means 3300 prevents the top sizer 4000 from being released from the hanger hook 210.

However, it should be understood by a person of ordinary skill in the art that the complementary configuration of the hanger and the top sizer can be different from the embodiments described and depicted above. More importantly, it should be recognized that any type of top sizer is compatible with the intimate apparel hanger according to the present invention.

Furthermore, the hanger can include mounting features disposed at the lower neck region of the hanger for attaching a lower neck sizer, releasably or unreleasably, such as a side lower neck sizer mounted to one side of the hanger hook or a sizer mounted to substantially surround the hanger hook.

Referring back to FIG. 3, similar to the sectional view of the hanger beam shown in FIG. 2, the hanger body 220 of the current embodiment has a ratio of width to height larger than 1. More preferably, the width of the hanger body 220 is within the range of 3-8 mm, and the height of the hanger body 220 is within the range of 3-8 mm. Accordingly, the intimate apparel hanger 200, according to the present embodiment, provides a so-called micro-beam intimate apparel hanger, with a minimized and compact configuration for the hanger body, which consumes less material during manufacturing and processing, while still maintaining superior structural integrity and mechanical performance.

FIG. 8 illustrates an intimate apparel hanger 500 according to another embodiment of the present invention. The hanger 500 includes a hook 510 and hanger body 520, integrally molded to each other.

The hook 510 includes a substantially planar web 511, bounded by a first hook flange 512 and a second hook flange 513. The first hook flange 512 and the second hook flange 513 join each other at a tip 514 of the hook 210. The hanger body 520 includes a first arm 521 extending from the hook 510 to a first end 522 of the hanger body 520 and an opposite second arm 523 extending from the hook 510 to a second end 524 of the hanger body 520. The first arm 521 and the second arm 523 are preferably structurally and geometrically symmetrical to one another.

Preferably, both the first arm 521 and the second arm 523 are curved to extend away from the hook 510 and upwardly from the lowest point of the hanger body 520, to provide a wave-like streamlined hanger beam configuration.

The first end 522 is equipped with a first composite garment retaining clip 530, and the second end 524 is equipped with a second composite garment retaining clip 540. The first composite garment retaining clip 530 includes a first vertical garment retaining clip 532, molded to the first end 522 of the hanger body 520.

The first composite garment retaining clip 530 further includes a first lower garment retaining clip 534, molded to the first end 522 of the hanger body 520, extending inwardly under the hanger body 520 from the end 522 toward the hook 510. The first composite garment retaining clip 530 further includes a first upper garment retaining clip 536, molded to the first end 522 of the hanger body 520, extending inwardly above the hanger body 520 from the end 522 toward the hook 510.

The second composite garment retaining clip 540 includes a second vertical garment retaining clip 542, molded to the second end 524 of the hanger body 520. The second composite clip 540 further includes a second lower garment retaining clip 544 molded to the second end 524 of the hanger body 520, extending inwardly under the hanger body 520 from the second end 524 toward the hook 510. The second composite garment retaining clip 540 further includes a second upper garment retaining clip 546 molded to the second end 524 of the hanger body 520, extending inwardly above the body 520 from the second end 524 toward the hook 510.

The planar web 511 of the hanger hook 510 includes an expanded central portion 515, rising from the lower end of the hook 510, where the hook 510 joins the hanger body 520. The expanded central portion 515 expands the intersecting area between the hook 510 and the hanger body 520, so as to improve the structural integrity of the hanger hook 510 and the hanger body 520. Furthermore, the expanded central portion 515 increases the distance between the top of the hook 510, which engages a rod or rack for hanging the garment, and the top of the garment retaining clips 530 and 540, so as to reduce the interference between the garment and the rod or rack for hanging the garment.

FIG. 9 illustrates a sectional view of the first arm 521 along lines 9-9 in FIG. 8. The first arm 521, as shown, includes an upper flange 552 and an opposite lower flange 554, connected by a middle web 556. Preferably, the upper flange 552 and the lower flange 554 are substantially horizontal and parallel to each other, and the middle web 556 is substantially vertical to the upper and lower flanges, to provide a substantially I-beam configuration for the hanger body 520

Referring to FIGS. 8 and 9, the first arm 521 further includes a plurality of elongated openings 558 formed in the middle web 556. Similarly, the second arm 523 also includes a plurality of elongated openings 558 formed in the middle web of the second arm. Preferably, the elongated openings 558 extend substantially between the upper flange 552 and the lower flange 554. Preferably, the elongated openings 558 are separated by a plurality of struts 559, extending perpendicularly between the upper flange 552 and the lower flange 554 of the hanger body 520. Accordingly, the hanger body 520 has a railway-shaped configuration.

Alternatively, the openings 558 can be of any suitable configuration, including but not limited to, circular, triangular, square, polygon and so on, depending on the circumstances of using the hanger. Furthermore, the distribution and arrangement of the plurality openings 558, with respect to the flanges 552 and 554 and each other, can be different depending on the circumstances of using the hanger.

As shown in FIG. 8, preferably, the elongated openings 558 account for about 10-90% of the total area of the middle web 556 of the hanger body 520, and the mechanical strength and structural integrity of the intimate apparel hanger 500 is still maintained. More preferably, the elongated openings 558 account for about 70-85% of the total area of the middle web 556 of the hanger body 520, and the mechanical strength and structural integrity of the intimate apparel hanger 500 is still maintained.

As shown in FIG. 9, the hanger arm 521 has a second height H2 defined from the uppermost point of the upper flange 552 to the lowest point of the lower flange 554. The hanger arm 521 further has a second width W2 defined as the width of the upper flange 552 and the lower flange 554. Preferably, the ratio of the second width W2 to the second height H2 (W2/H2) is more than 1. More preferably, the second width W2 is within the range of 3-8 mm, and the second height H2 is within the range of 3-8 mm. Accordingly, the intimate apparel hanger 500, according to the current embodiment, provides a so-called micro-beam intimate apparel hanger, with a minimized and compact configuration for the hanger body, which consumes less material during manufacturing and processing, while still maintaining superior structural integrity and superior mechanical performance, relative to the larger, heavier prior art intimate apparel hangers.

FIG. 10 illustrates an intimate apparel hanger 600 according to still another embodiment of the present invention. The intimate apparel hanger 600 includes a hook 610 and a hanger body 620 integrally molded with the hook. The hanger body 620 includes a pair of arms 621 and 623, extending oppositely from the hook 610 to the ends 622 and 624, respectively. The hanger 600 further includes a pair of composite garment retaining clips 630 and 640 integrally molded to the ends 622 and 624, respectively. The hook 610 includes an expanded central portion 615 at the intersection region between the hook and the hanger body.

The first composite garment retaining clip 630 further includes a first lower garment retaining clip 634, molded to the first end 622 of the hanger body 620, extending inwardly under the hanger body 620 from the end 622 toward the hook 610. The first composite garment retaining clip 630 further includes a first upper garment retaining clip 636, molded to the first end 622 of the hanger body 620, extending inwardly above the hanger body 620 from the end 622 toward the hook 610.

The second composite garment retaining clip 640 includes a second vertical garment retaining clip 642, molded to the second end 624 of the hanger body 620. The second composite clip 640 further includes a second lower garment retaining clip 644 molded to the second end 624 of the hanger body 620, extending inwardly under the hanger body 620 from the second end 624 toward the hook 610. The second composite garment retaining clip 640 further includes a second upper garment retaining clip 646 molded to the second end 624 of the hanger body 620, extending inwardly above the body 620 from the second end 624 toward the hook 610.

The top sizer attaching means 700 is of a configuration similar to the top sizer attaching means 300 shown in FIG. 3 or the top sizer attaching means 3000 in FIG. 3A.

Figure 11:
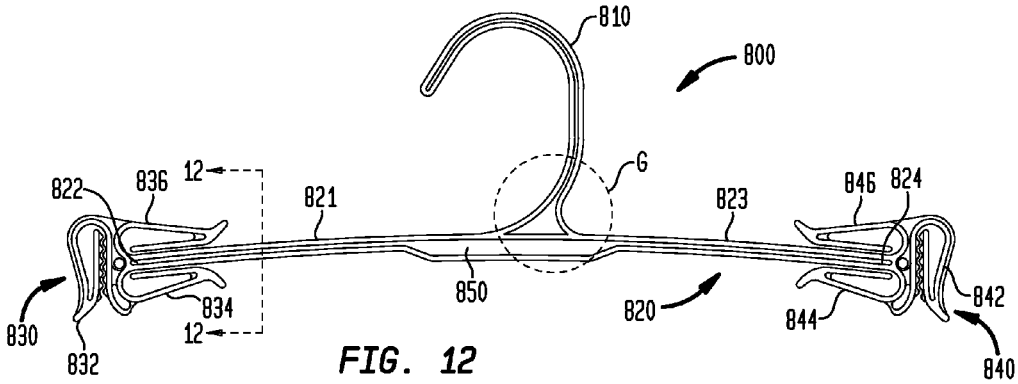
FIG. 11 illustrates a front elevation view of an intimate apparel hanger according to another exemplary embodiment of the present invention.

FIG. 11 illustrates an intimate apparel hanger 800 according to still another embodiment of the present invention. The hanger 800 includes a hook 810 and a hanger body 820, integrally molded with each other at the lower neck region G of the hanger 800. The hanger body 820 includes a first arm 821 extending from the hook 810 to a first end 822 of the hanger body 820, and a second arm 823 extending from the hook 810 to a second distal end 824 of the hanger body 820.

The hanger 800 further includes a first composite garment retaining clip 830, integrally molded to the first end 822, and a second composite garment retaining clip 840, integrally molded to the second end 824. The first composite garment retaining clip 830 includes a first vertical garment retaining clip 832, molded to the first end 822 of the hanger body 120. The first composite garment retaining clip 830 further includes a first lower garment retaining clip 834, molded to the first end 822 of the hanger body 820, extending inwardly under the hanger body 820 from the end 822 toward the hook 810. The first composite garment retaining clip 830 further includes a first upper garment retaining clip 836, molded to the first end 822 of the hanger body 820, extending inwardly above the hanger body 820 from the end 822 toward the hook 810.

The second composite garment retaining clip 840 includes a second vertical garment retaining clip 842, molded to the second end 824 of the hanger body 820. The second composite clip 840 further includes a second lower garment retaining clip 844 molded to the second end 824 of the hanger body 820, extending inwardly under the hanger body 820 from the second end 824 toward the hook 810. The second composite garment retaining clip 840 further includes a second upper garment retaining clip 846 molded to the second end 824 of the hanger body 820, extending inwardly above the body 820 from the second end 824 toward the hook 810.

Figure 12:
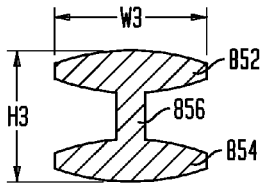
FIG. 12 illustrates a sectional view of the hanger body of the intimate apparel hanger shown in FIG. 11, along lines 12-12 in FIG. 11.

Both the first arm 821 and the second arm 823 are substantially horizontal, to provide a substantially horizontal elongated hanger beam. FIG. 12 illustrates a sectional view of the first arm 821, along lines 12-12 in FIG. 11.

As shown in FIG. 12, the first hanger arm 821 includes a substantially horizontal upper flange 852 and an opposite lower flange 854, connected to each other through a middle web 856. The flanges provide a substantially I-beam configuration. The second arm 823 preferably has same structure as the first arm 821.

Specifically, the first arm 821 has a third height H3 defined from the uppermost point of the upper flange 852 to the lowest point of the lower flange 854. The hanger arm 821 further has a third width W3 defined as the width of the upper flange 852 and the lower flange 854. Preferably, the ratio of the third width W3 to the third height H3 (W3/H3) is more than 1. More preferably, the third width W3 is within the range of 3-8 mm, and the third height H3 is within the range of 3-8 mm. Accordingly, the intimate apparel hanger 800, according to the current embodiment, provides a so-called micro-beam intimate apparel hanger, with a minimized and compact configuration for the hanger body, which consumes less material while still maintaining agreeable structure integrity and mechanical performance.

The hanger body 820 further includes a vertically enlarged portion 850 under the hanger hook 810. The enlarged portion 850 has a height larger than that of the third height H3. The vertically enlarged portion 850 serves to strengthen the intersection region of the hook 810 and the body 820, and provide an anti-twist mechanism for the hanger 800. Preferably, the vertically enlarged portion 850 extends from the hook 810 to the ends 822 and 824, respectively. More preferably, the length of the enlarged portion 850 is about ¼ to ½ of the entire length of the hanger body 820.

Figure 13:
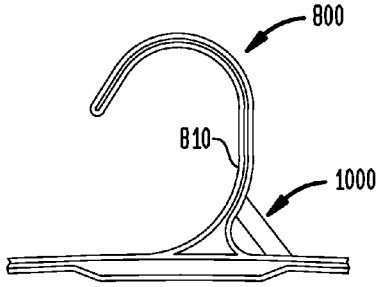
FIG. 13 illustrates a partial front elevation view of the intimate apparel hanger shown in FIG. 11, with a side lower neck sizer mounted to a side of the hook, adjacent to the lower neck region of the hanger.

Referring to FIG. 13, a side sizer 1000 is shown attached to a side of the hook 810 of the hanger 800, adjacent to the lower neck region G of the hanger 800. The side sizer 1000 serves to display indicia related to the attributes of the intimate apparel, such as size, color and so on. The side sizer 1000 is mounted to a complementary mounting structure provided at one side of the hook 810, either releasably or unreleasably. For example, the side sizer 1000 can include inwardly extended fingers and flanges to engage a pivotal web and a fixed web of the mounting structure, to releasably attach the side sizer 1000 to the hanger 800, adjacent to the lower neck region.

Figure 14:
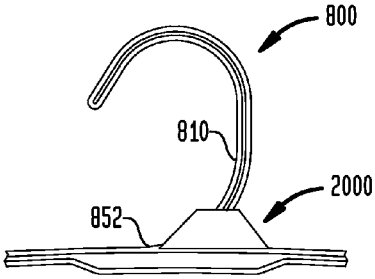
FIG. 14 illustrates a partial front elevation view of the intimate apparel hanger shown in FIG. 11, with a lower neck sizer mounted on the hanger to substantially surrounding the hook, adjacent to the lower neck region of the hanger.

Referring to FIG. 14, a lower neck sizer 2000 is shown attached to substantially surround the hook 810 of the hanger 800, adjacent to the lower neck region G of the hanger 800. The lower neck sizer 2000 serves to display garment-related information. The lower neck sizer 2000 includes an upper opening and a lower opening to provide a channel, through which the lower neck sizer 2000 passes over the hook 810 of the hanger and sits on the upper flange 852 of the hanger body 820. Anti-releasing means and implement can be formed on the hanger hook 810 or the hanger body 820 to prevent accidental detachment of the lower neck sizer 2000.

It should be understood by a person of ordinal skill in the art that the structure and configuration of the side sizer or the lower neck sizer can be varied without departing from the present invention.

Figure 15:
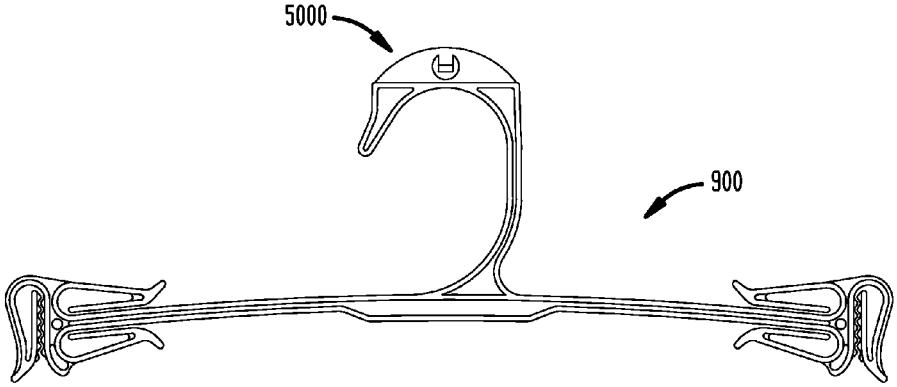
FIG. 15 illustrates a front elevation view of an intimate apparel hanger according to another exemplary embodiment of the present invention.

FIG. 15 illustrates an intimate apparel hanger 900 according to still another embodiment of the present invention. The hanger 900 has similar hanger structures to the hanger 800, except that the hanger 900 further includes a top sizer attaching means 5000. For example, the top sizer attaching means 5000 can be of a same or similar configuration as the top sizer attaching means 300 shown in FIG. 3 or the top sizer attaching means 3000 shown in 3A, or any other top sizing available to those skilled in the art.

The plastic hanger of the present invention can be formed of styrene, which provides a clear, virtually transparent hanger for maximum display of intimate apparel garments, such as bras and panties, to be suspended therefrom. In the alternative, the hanger can be molded from polypropylene, preferably high impact styrene polypropylene, polyvinylchloride, ABS or other suitable thermoplastics and mixtures thereof For additional reinforcement, K resin can be added to the plastic material.

From the foregoing illustrations it is readily apparent that the present invention is directed to an improved intimate apparel hanger suitable for industry mass production. The present invention offers reliable mechanical performance and structural integrity to the hangers, satisfying industry standards, such as, the VICS standards.

The present invention has been described with respect to certain exemplary embodiments. Certain alterations and/or modifications will be apparent to those skilled in the art, in light of the instant disclosure, without departing from the spirit or the scope of the invention. These embodiments are offered as merely illustrative, and not limiting, on the scope of the invention, which is defined solely with reference to the following appended claims.

I claim:

1. A lightweight intimate apparel hanger, comprising:

a hook member;

a body connected to the hook at a lower neck region of the hanger, the body comprising a first arm extending from the hook to a first end of the body and a second arm extending from the hook to a second end of the body, the first arm and the second arm body each comprising an upper flange, a lower flange and a middle web connecting the upper flange and the lower flange, the upper flange having an uppermost surface and the lower flange having a lowermost surface substantially to the upper most surface to define a uniform height H along the hanger body, the upper flange and the lower flange together defining a first lateral most surface and an opposite second lateral most surface and a uniform width W between the first lateral most surface and the second lateral most surface; and a first composite garment retaining clip integrally molded to the first end of the body and a second composite garment retaining clip integrally molded the second end of the body;

wherein the ratio of the uniform width W to the uniform height H (W/H) being larger than 1.

2. The lightweight intimate apparel hanger according to claim 1, wherein the upper flange, the lower flange and the middle web form a substantially I-beam cross section of the body.

3. The lightweight intimate apparel hanger according to claim 1, wherein the first composite clip comprises a first vertical garment retaining clip, a first lower garment retaining clip disposed under the body, and a first upper garment retaining clip disposed above the body.

4. The lightweight intimate apparel hanger according to claim 3, wherein the second composite clip comprises a second vertical garment retaining clip, a second lower garment retaining clip disposed under the body, and a second upper garment retaining clip disposed above the body.

5. The lightweight intimate apparel hanger according to claim 1, wherein the first arm and the second arm are substantially horizontal, thereby providing a substantially horizontal elongated hanger body.

6. The lightweight intimate apparel hanger according to claim 1, wherein the first arm and the second arm are curved to extend away from the hook and upwardly from the lower neck region of the hanger, thereby providing a wave-like streamlined hanger body.

7. The lightweight intimate apparel hanger according to claim 1, wherein the width W is within the range of 3-8 mm, and the height H is within the range of 3-8 mm.

8. The lightweight intimate apparel hanger according to claim 1, wherein the hook comprises a planar web and an inner flange, the inner flange extending substantially from a tip of the hook to the lower neck region of the hanger and continuously with the upper flange, for strengthening the hook and providing a larger load bearing surface for the hook.

9. The lightweight intimate apparel hanger according to claim 8, further comprising a reinforcing rib disposed oppositely to the inner flange, extending substantially at the lower neck region of the hanger and continuously with the upper flange, for strengthening the hook.

10. The lightweight intimate apparel hanger according to claim 8, wherein the hook further comprises a carved out portion formed in the planar web, for reducing the weight of the hanger.

11. The lightweight intimate apparel hanger according to claim 1, wherein the hanger further comprises at least one elongated opening formed in the middle web of the hanger body.

12. The lightweight intimate apparel hanger according to claim 11, wherein the hanger comprises a plurality of elongated openings formed in the middle web of the hanger body and separated from each other through a plurality of struts between the upper flange and the lower flange.

13. The lightweight intimate apparel hanger according to claim 12, wherein the plurality of elongated openings account for about 10-90% of the total area of the middle web of the hanger body.

14. The lightweight intimate apparel hanger according to claim 1, wherein the hanger further comprises a top sizer attaching means, disposed at the top of the hook for engaging a top sizer.

15. The lightweight intimate apparel hanger according to claim 14, wherein the top sizer attaching means comprises a horizontal flange formed at the top the hook, upon which a top sizer is positioned to display garment-related information.

16. The lightweight intimate apparel hanger according to claim 15, wherein the top sizer attaching means further comprises a vertical flange, extending upwardly substantially from the middle of the horizontal flange, the vertical flange being adapted to be received within a cavity of the top sizer.

17. The lightweight intimate apparel hanger according to claim 16, wherein the top sizer attaching means further comprises an opening formed in the vertical flange, and a downwardly depending tab extending within the opening.

18. The lightweight intimate apparel hanger according to claim 17, wherein the top sizer attaching means further comprises a lateral abutment formed at the lower end of the tab, projecting downwardly and laterally outwardly from the opening for engaging a lower surface of a through opening in the top sizer.

19. The lightweight intimate apparel hanger according to claim 16, wherein the top sizer attaching means further comprises at least one snap fit engagement means projecting from the vertical flange, said snap fit engagement means comprising a sloped surface and an abutment surface, and wherein the abutment surface engages a lower surface of a blind slot formed in the top sizer.

20. The lightweight intimate apparel hanger according to claim 1, wherein the hanger further comprises a lower neck sizer attaching means, disposed at the lower neck region of the hanger, for attaching at least one of a side lower neck sizer mounted to a side of the hook adjacent to the lower neck region and a lower neck sizer mounted to substantially surrounding the hook adjacent to the lower neck region.

21. The lightweight intimate apparel hanger according to claim 1, wherein the hanger body further comprises a vertically enlarged portion formed under the hanger hook, for structurally strengthening the hanger adjacent to the lower neck region and providing an anti-twist mechanism for the hanger.

22. The lightweight intimate apparel hanger according to claim 1, wherein the hanger hook further comprises an expanded central portion, rising from the upper flange of the hanger body.

* * * * *